US006055819A

United States Patent [19]

Kang

[11] Patent Number: 6,055,819

[45] Date of Patent: May 2, 2000

[54] APPARATUS AND METHOD FOR PREVENTING AN EVAPORATING FOR AN AIR CONDITIONING SYSTEM FORM FREEZING

[75] Inventor: Hoon Kang, Incheon, Rep. of Korea

[73] Assignee: Daewoo Electrics Co., Ltd., Seoul, Rep. of Korea

[21] Appl. No.: 09/092,911

[22] Filed: Jun. 8, 1998

[30] Foreign Application Priority Data

Jun. 28, 1997 [KR] Rep. of Korea ..... P97/28557
Jun. 28, 1997 [KR] Rep. of Korea ..... P97/28559

[51] Int. Cl.[7] ..... F25B 39/04

[52] U.S. Cl. ..... 62/184; 62/156; 62/181; 62/DIG. 17

[58] Field of Search ..... 62/183, 184, 181, 62/156, DIG. 17

[56] References Cited

U.S. PATENT DOCUMENTS

| | | | |
|---|---|---|---|
| 2,943,457 | 7/1960 | Wile | 62/184 |
| 3,122,895 | 3/1964 | Woods | 62/184 |
| 3,354,665 | 11/1967 | Lewis | 62/184 |
| 3,415,071 | 12/1968 | Kompelien | 62/158 |
| 3,735,602 | 5/1973 | Ramsey | 62/184 |
| 3,817,451 | 6/1974 | Ramsey | 236/49 |
| 4,251,999 | 2/1981 | Tanaka . | |
| 4,531,378 | 7/1985 | Nishi . | |
| 5,385,030 | 1/1995 | Kitigawa et al. | 62/160 |
| 5,724,826 | 3/1998 | Han | 62/183 |

FOREIGN PATENT DOCUMENTS 9624016 8/1996 WIPO .

OTHER PUBLICATIONS

Japanese Abstract, vol. 17, No. 206, (M–1400), Apr. 1993.

*Primary Examiner*—Henry Bennett
*Assistant Examiner*—Marc Norman
*Attorney, Agent, or Firm*—Pillsbury Madison & Sutro LLP

[57] ABSTRACT

A method for preventing an evaporator of an air conditioner from freezing comprises the steps of (1) detecting an outdoor temperature, (2) determining whether or not the outdoor temperature is 20° C., (3) determining whether or not the outdoor temperature is in a first temperature range, (4) determining whether or not the outdoor temperature is in a second temperature range, (5) varying an R.P.M. of the motor assembly based on the outdoor temperature detected in steps (3) and (4), (6) detecting a surface temperature of a condenser and determining whether or not the surface temperature of the condenser is in a third temperature range, (7) repeating steps (1) through (6) if the surface temperature of the condenser is higher than the third temperature range, and (8) rotating the motor assembly at a low speed if the surface temperature of the condensor is lower than the third temperature range. The apparatus is the advantageous in that the apparatus constantly maintains the internal pressure of the evaporator by varing the R.P.M. of the motor assembly according to the outdoor temperature and surface temperature of the condenser so that the internal pressure of the evaporator is constantly maintained, thereby preventing the evaporator of the air-conditioning system from freezing.

13 Claims, 7 Drawing Sheets

300

315
FIRST TEMPERATURE DETECTING SENSOR
SECOND TEMPERATURE DETECTING SENSOR
325
CONDENSER
310
345
CONTROL UNIT
355
INVERTER
MOTOR
335

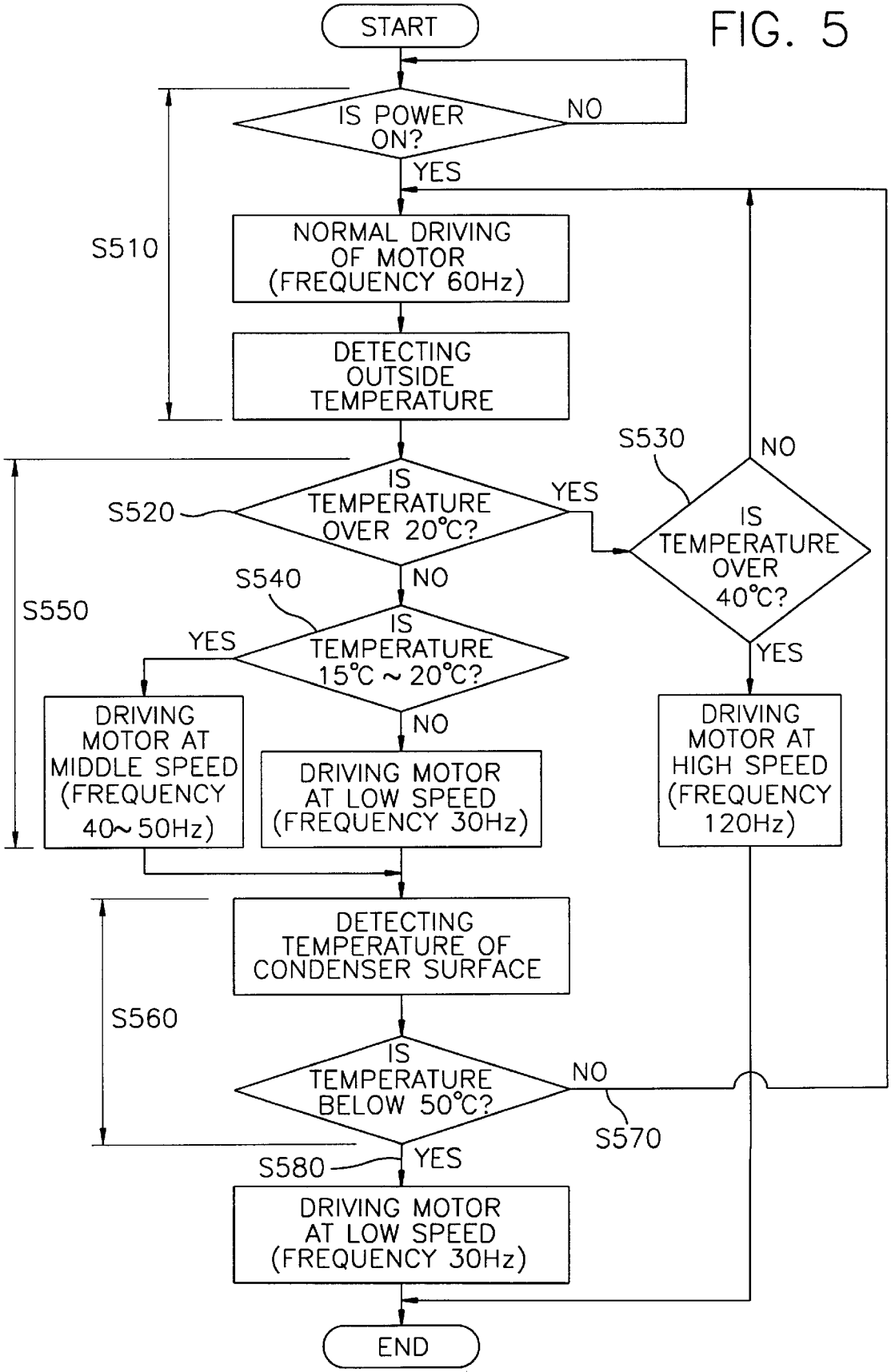
FIG. 5
START
IS POWER ON?
NO
YES
S510
NORMAL DRIVING OF MOTOR (FREQUENCY 60Hz)
DETECTING OUTSIDE TEMPERATURE
S520
IS TEMPERATURE OVER 20℃?
YES
NO
S530
IS TEMPERATURE OVER 40℃?
NO
YES
S550
S540
IS TEMPERATURE 15℃ ~ 20℃?
YES
NO
DRIVING MOTOR AT MIDDLE SPEED (FREQUENCY 40~50Hz)
DRIVING MOTOR AT LOW SPEED (FREQUENCY 30Hz)
DRIVING MOTOR AT HIGH SPEED (FREQUENCY 120Hz)
S560
DETECTING TEMPERATURE OF CONDENSER SURFACE
IS TEMPERATURE BELOW 50℃?
NO
S570
S580
YES
DRIVING MOTOR AT LOW SPEED (FREQUENCY 30Hz)
END

APPARATUS AND METHOD FOR PREVENTING AN EVAPORATING FOR AN AIR CONDITIONING SYSTEM FORM FREEZING

BACKGROUND OF THE INVENTION

1. Field of the Invention

The present invention relates to an air-conditioning system, and more particularly to an apparatus and method for preventing an evaporator for the air-conditioning system from freezing.

2. Description of the Prior Art

An air-conditioning system is an apparatus for cooling an internal room by supplying an air which is cooled by an evaporating heat of a refrigerant.

Generally, the air-conditioning system has a compressor for compressing the refrigerant in a high temperature and pressure, a condenser for liquefying the gas-refrigerant, which is of high temperature and pressure by cooling, a receiver tank for separating a gas-refrigerant from a liquid-refrigerant which is supplied from the condenser so as to supply to an expansion valve, and an evaporator for evaporating an atomized liquid-refrigerant, which became low in pressure by passing through the expansion valve, thereby generating the cooled air.

In the air-conditioning system, when an electric power is applied to the air-conditioning system, the compressor is operated so that the refrigerant is compressed in the high temperature and pressure. The refrigerant, which is of high temperature and pressure, is supplied to the condenser, and is cooled by the air blown from a blower. The refrigerant, which is liquified in the condenser, is expanded by passing through the expansion valve, and the expanded atomized-refrigerant is sucked into the evaporator. The refrigerant, which is sucked into the evaporator, is evaporated while the surface of the evaporator is cooled by the air. Since the evaporator absorbs a surrounding heat thereof by the evaporating heat of the refrigerant, a cooling pin, which is formed at an outer surface of the evaporator, is cooled. At this time, the outer air passes through the blower, is cooled by the evaporator, and then is supplied to the room.

However, when the temperature of the evaporator surface is below 0 degrees or has a big temperature difference between the temperature of the outer air and the internal air, the surface of the evaporator frosts easily. Accordingly, the apparatus for preventing the surface of the evaporator from freezing, in which a throttle valve is mounted thereon for controlling an internal pressure of the evaporator to prevent the freezing of the evaporator surface, is disclosed. Which is issued to the U.S. Pat. No. 4,531,378.

FIG. 1 is a schematic view showing a structure of a conventional air-conditioning system, and FIG. 2 is a sectional view showing the throttle valve mounted on the conventional air-conditioning system. As illustrated, the air-conditioning system has a clutch 105 for transmitting or intercepting a power transmitted from an engine (not shown) to the air-conditioning system, a compressor 110 connected to the clutch 105 for compressing the refrigerant in high temperature and high pressure gas by a piston, and having a displacement varying device, a condenser 120 for condensing the gas-refrigerant supplied from the compressor 110, which is of high temperature and pressure, a receiver tank 140 for separting the gas from the liquid-refrigerant supplied from the condenser 120 and for supplying the liquid-refrigerant to the expansion valve 150, an evaporator 160 for evaporating the atomized-refrigerant supplied from the receiver tank 140 so as to absorb a surrounding heat, and a throttle valve 170 mounted between the evaporator 160 and the compressor 110 for controlling the pressure of the refrigerant so as to prevent the surface of the evaporator 160 from freezing.

When the internal pressure of the evaporator 160 rises or falls, the throttle valve 170 maintains the internal pressure of the evaporator 160 at a predetermined pressure so as to prevent the surface of the evaporator 160 from freezing.

The inlet 173 of the throttle valve 170 is connected to the evaporator 160, and the outlet 175 of the throttle valve 170 is connected to the compressor 110. The throttle valve 170 has a spring 172 mounted at an internal upper portion thereof, a diaphragm 174 connected to an end portion of the spring 172, and a valve body 176 connected to an end portion of the diaphragm 174.

If a cooling load of the evaporator 160 is lowered, the internal pressure of the evaporator 160 is lowered. Thus, the pressure of the refrigerant which flows into the throttle valve 170 is lowered. Accordingly, the elastic force of the spring 172 of the throttle valve 170 is greater than the pressure of the refrigerant which flows from the evaporator so that the valve body 176 moves in a lower direction. Accordingly, the valve body 176 intercepts a conduit 177 into which the refrigerant flows so as to prevent the refrigerant from flowing to the compressor 110. Consequently, the internal pressure of the evaporator 160 rises, the internal pressure of the evaporator 160 is maintained in a predetermined pressure. Accordingly, the throttle valve 170 prevents the temperature of the evaporator 160 from falling below 0 degrees, thereby preventing the evaporator of the air-conditioning system from freezing.

On the other hand, if the cooling load of the evaporator 160 rises, the internal pressure of the evaporator 160 also rises. Thus, the pressure of the refrigerant which flows into the throttle valve 170 rises. Accordingly, the elastic force of the spring 172 of the throttle valve 170 is smaller than the pressure of the refrigerant which flows from the evaporator 160 so that the valve body 176 moves in the upper direction. Accordingly, the conduit is opened, and the refrigerant is sucked into the compressor 110. Consequently, the internal pressure of the evaporator 160 is maintained at the predetermined pressure. Accordingly, the throttle valve 170 prevents the temperature of the evaporator 160 from falling below 0 degrees so as to prevent the evaporator 160 of the air-conditioning system from freezing.

On the other hand, a sensor for detecting the position of the valve body of the throttle valve 170 is provided. The sensor 180 detects the upper or lower movements of the valve body 176 and sends the signal to a control section 145. The control section 145 is connected to a displacement varying device 190 of the compressor 110. The control section 145 receives the signal from the sensor 180 for driving the displacement varying device of the compressor 110. Accordingly, the compressor 110 controls a compress capacity according to the cooling load of the evaporator 160 so as to prevent the evaporator 160 of the air-conditioning system from freezing.

However, since the conventional apparatus for preventing the evaporator of the air-conditioning system from freezing prevents the freezing of the evaporator by detecting the pressure of the refrigerant which flows into the compressor from the evaporator, it is difficult to adjust to the cooling load caused by the temperature difference between the temperature of the indoor air and the outdoor air.

SUMMARY OF THE INVENTION

Accordingly, the present invention has been made to solve the foregoing problem. Generally, when the temperature of the surface of the evaporator is below 0 degrees, the surface of the evaporator is frozen. Accordingly, the object of the present invention is to provide the apparatus for preventing the evaporator from freezing and the method, in which the apparatus drives a fan at a variable speed according to the temperature of the outdoor air, and the condenser for constantly maintaining the internal pressure of the evaporator thereby preventing the evaporator of the air-conditioning system from freezing.

In order to achieve the above object, the present invention provides an apparatus for preventing an evaporator of an air conditioner from freezing, the apparatus comprising:

a fan disposed at a front of a condenser for blowing an air toward the condenser;

a first temperature sensor which detects an outdoor temperature and generates a first signal;

a second temperature sensor which detects a surface temperature of the condenser and generates a second signal;

a control section which receives the first and second signals from the first and second temperature sensors and generates a control signal based on the first and second signals for varying an R.P.M. of a motor assembly, the motor assembly connected to the fan for rotating the fan; and an inverter which receives the control signal from the control section and modulates a frequency supplied thereto from a power source based on the control signal, thereby applying a modulated frequency to the motor assembly, wherein the control section generates a first control signal for rotating the fan at a high speed when the outdoor temperature is higher than a first predetermined temperature, the control section generates a second control signal for rotating the fan at a middle speed when the outdoor temperature is lower than the first predetermined temperature, and the control section generates a third control signal for rotating the fan at a low speed when the surface temperature of the condenser is lower than a second predetermined temperature, thereby constantly maintaining an internal pressure of the condenser.

According to the present invention, the control section determines whether or not the outdoor temperature is 20 degrees, and the control section rotates the fan at the variable speed, thereby constantly maintaining the internal pressure of the condenser. When the outdoor temperature is over 20 degrees, the control section determines whether or not the outdoor temperature is in a first temperature range. When the outdoor temperature is in the first temperature range, the control section drives the motor assembly at a normal speed. And, when the outdoor temperature is over the first temperature range, the control section drives the motor assembly at a high speed.

When the outdoor temperature is below 20 degrees, the control section determines whether or not the outdoor temperature is in a second temperature range. When the outdoor temperature is in the second temperature range, the control section drives the motor assembly at a middle speed. And, when the outdoor temperature is below the second temperature range, the control section drives the motor assembly at a low speed.

When the surface temperature of the condenser is over 50 degrees, the control section drives the motor assembly at the normal speed, when the surface temperature of the condenser is below 50 degrees, the control section drives the motor assembly at the low speed. The first temperature range is 20–40 degrees, the second temperature is 15–20 degrees. Moreover, the first and second temperature sensors is a resistance-type temperature detecting sensor.

The object of the present invention provides a method for preventing an evaporator of an air conditioner from freezing, the method comprising the steps of:

(1) detecting an outdoor temperature by a first temperature sensor while driving a motor assembly at a normal speed;

(2) determining whether or not the outdoor temperature is 20° C.;

(3) determining whether or not the outdoor temperature is in a first temperature range if the outdoor temperature detected in step (2) is higher than 20° C.;

(4) determining whether or not the outdoor temperature is in a second temperature range if the outdoor temperature detected in step (2) is lower than 20° C.;

(5) varying an R.P.M. of the motor assembly based on the outdoor temperature detected in steps (3) and (4);

(6) detecting a surface temperature of a condenser and determining whether or not the surface temperature of the condenser is in a third temperature range;

(7) repeating steps (1) through (6) if the surface temperature of the condenser is higher than the third temperature range; and (8) rotating the motor assembly at a low speed if the surface temperature of the condenser is lower than the third temperature range.

According to the method, step (3) has substeps of rotating the motor assembly at a high speed if the outdoor temperature is higher than the first temperature range, and returning to step (1) if the outdoor temperature is within the first temperature range. In step (4), the motor assembly is rotated at a middle speed if the outdoor temperature is within the second temperature range.

In step (4), the motor assembly is rotated at the low speed if the outdoor temperature is lower than the second temperature speed.

The first temperature range is 20–40 degrees, the second temperature range is 15–20 degrees, and the third temperature range is 50–52 degrees.

The object of the present invention provides a method for preventing an evaporator of an air conditioner from freezing, the method comprising the steps of:

(1) detecting an outdoor temperature by a first temperature sensor while driving a motor assembly;

(2) determining whether or not the outdoor temperature is a first predetermined temperature;

(3) rotating the motor assembly at a normal speed if the outdoor temperature detected in step (2) is higher than the first predetermined temperature;

(4) stopping an operation of the motor assembly if the outdoor temperature detected in step (2) is lower than the first predetermined temperature;

(5) detecting a surface temperature of a condenser;

(6) determining whether or not the surface temperature of the condenser is a second predetermined temperature;

(7) rotating the motor assembly at the normal speed if the surface temperature of the condenser detected in step (6) is higher than the second predetermined temperature; and (8) stopping the motor assembly if the surface temperature of the condenser detected in step (6) is lower than the second predetermined temperature.

The first temperature is 20 degrees, and the second temperature is 50 degrees.

The apparatus for preventing an evaporator of an air conditioner from freezing is the advantageous in that the apparatus constantly maintains the internal pressure of the evaporator by varying the R.P.M. of the motor assembly according to the outdoor temperature and surface temperature of the condenser so that the internal pressure of the evaporator is constantly maintained, thereby preventing the evaporator of the air-conditioning system from freezing.

BRIEF DESCRIPTION OF THE DRAWINGS

The above object and advantages of the present invention will become more apparent by describing in detail preferred embodiments thereof with reference to the attached drawings, in which:

FIG. 5 is a flow chart showing the first embodiment of the freeze-preventing apparatus of the air-conditioning system according to the present invention;

DETAILED DESCRIPTION OF THE INVENTION

Hereinafter, a preferred embodiment of the present invention will be explained in more detail with reference to the accompanying drawings.

Figure 1:
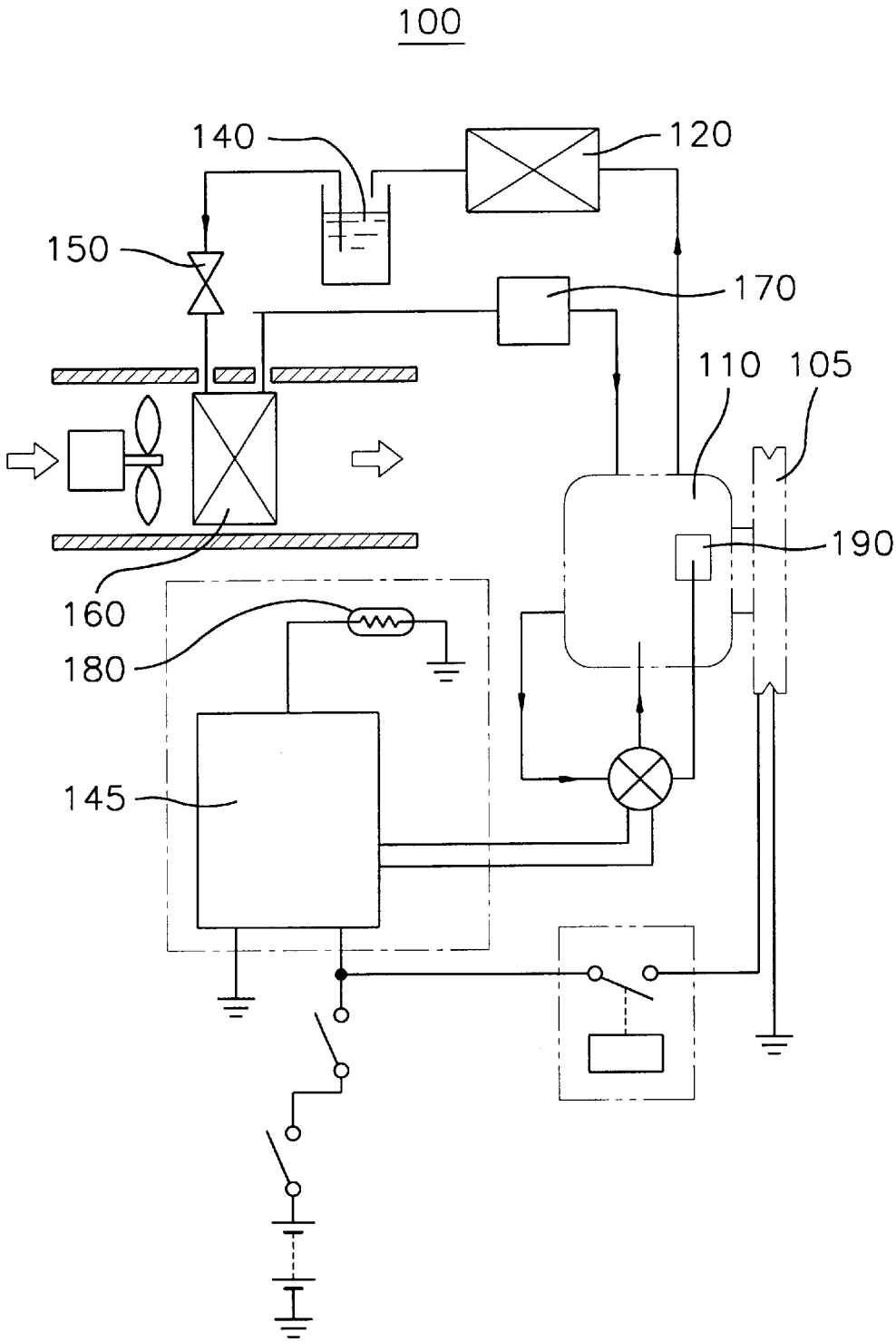
FIG. 1 (PRIOR ART)
FIG. 1 is a schematic view showing a structure of the conventional air-conditioning system.
Figure 2:
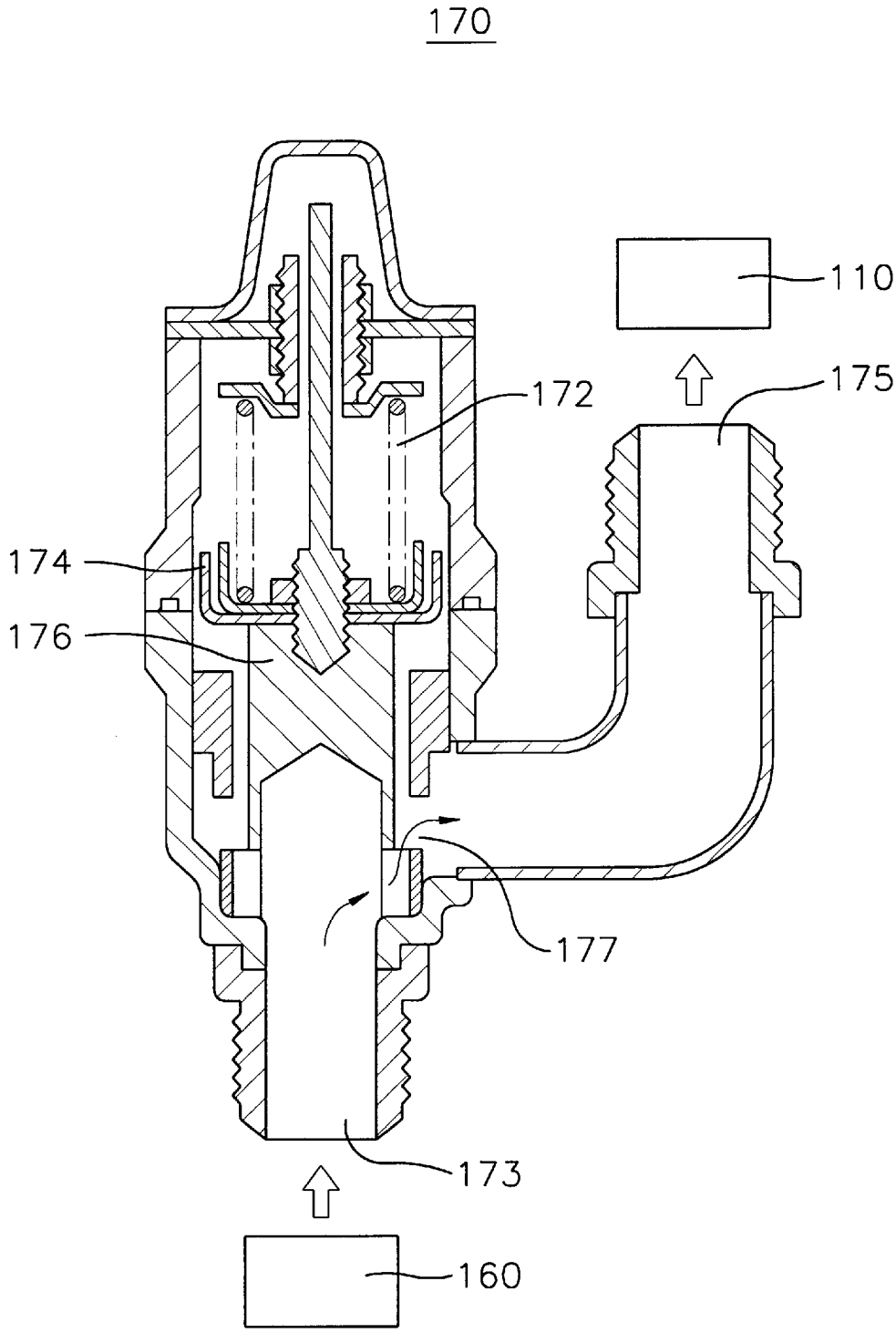
FIG. 2 (PRIOR ART)
FIG. 2 is a sectional view showing a throttle valve mounted on the conventional air-conditioning system.
Figure 3:
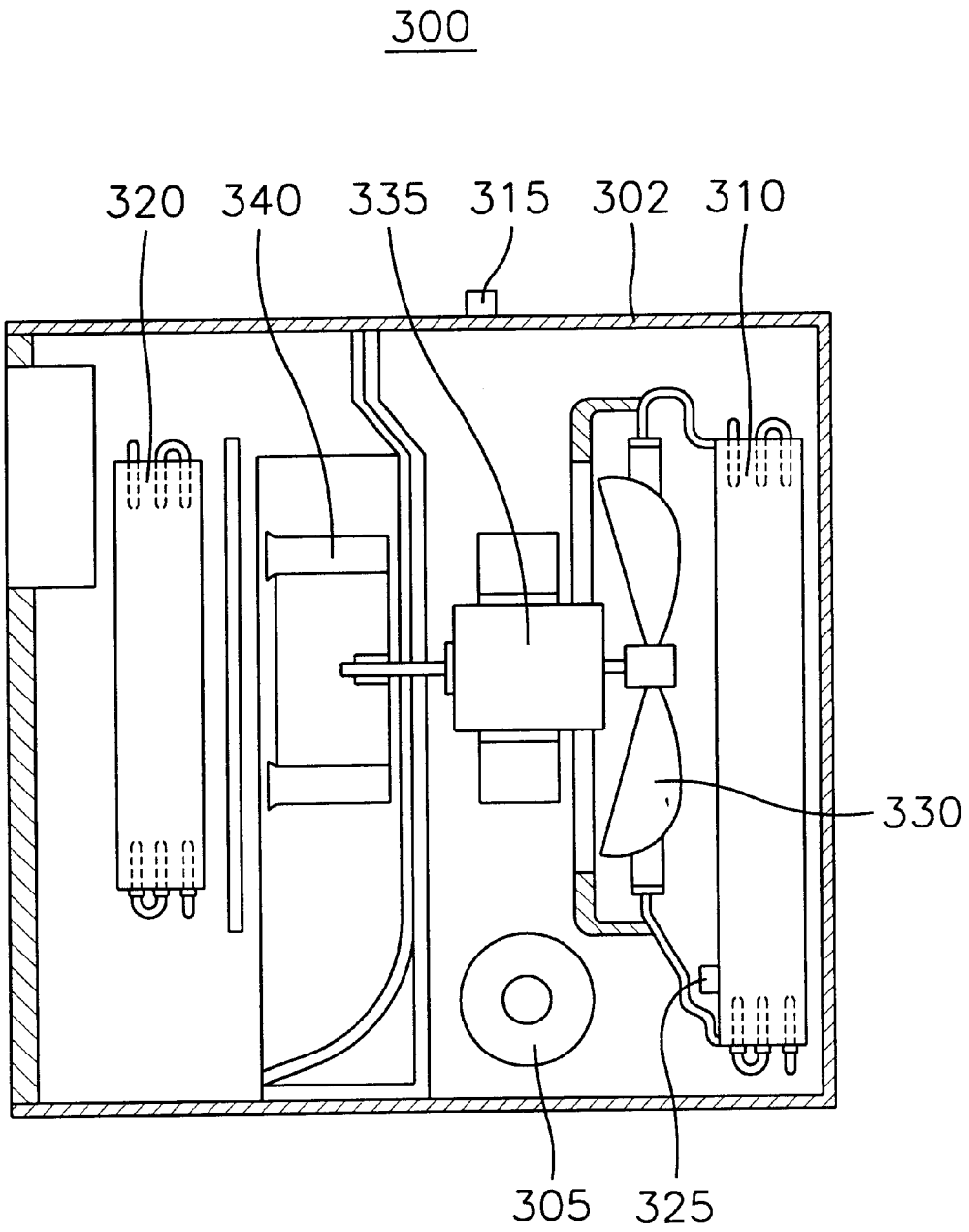
FIG. 3 is a plan view showing a structure of an air-conditioning system according to the present invention.

FIG. 3 is a sectional view showing a structure of the air-conditioning system 300. As illustrated in FIG. 3, the air-conditioning system 300 is separated from the outside by the compartment 302. The air-conditioning system 300 has a motor assembly 335 having at both sides a first and second blowing fan 330 and 340, a compressor 305 for compressing a refrigerant in a high temperature and pressure, a condenser 310 for cooling the gas-refrigerant, which is in a high temperature state, and for liquefying the gas-refrigerant, a first temperature sensor 315 for detecting the outdoor temperature and for generating a first signal, an evaporator for sucking a liquified refrigerant supplied from the condenser 310 through the receiver tank and the expansion valve and for evaporating a low pressure refrigerant which is in an atomized state to absorb the surrounding heat thereby cooling the air, a second temperature sensor 325 connected to an end portion of the condenser 310 for detecting the surface temperature of the condenser and for generating a second signal, and a control section (not shown) for receiving the first and second signals generated from the first and second temperature sensor 315 and 325 so as to rotate the motor assembly 335 at the variable speed.

Figure 4:
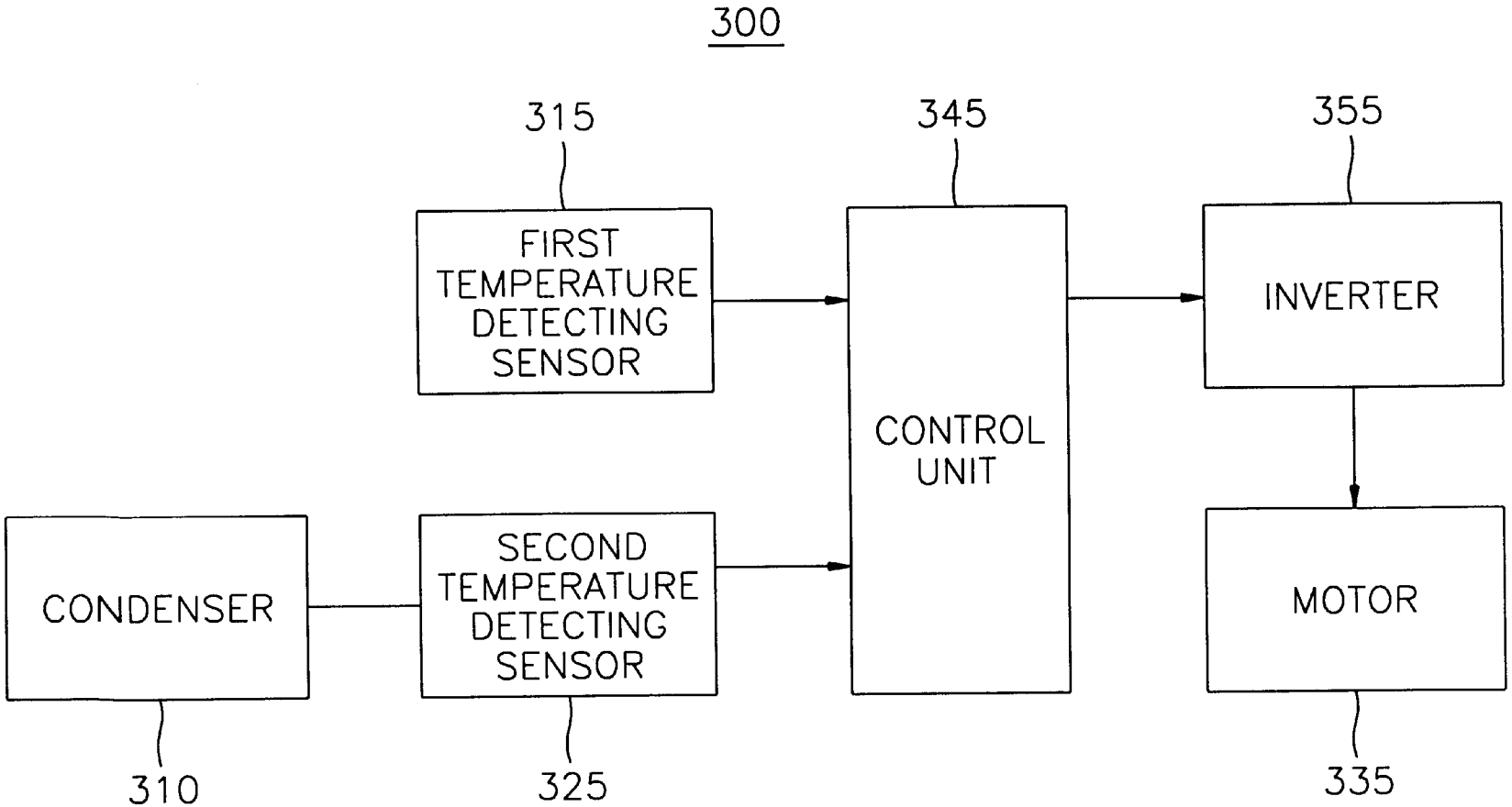
FIG. 4 is a block diagram showing a first embodiment of a freeze-preventing apparatus of the air-conditioning system according to the present invention.

FIG. 4 is the block diagram of the apparatus according to the first embodiment of the present invention. As illustrated, the control section 345 is connected to the first temperature sensor 315 which detects the outdoor temperature for sending the first signal to the control section 345 and the second temperature sensor 325 which detects the surface temperature of the condenser 310 for sending the second signal to the control section 345. The control section 345 receives the first and second signals generated from the first and second temperature sensors 315 and 325, and the control section 345 sends the control signal to the inverter 355 for rotating the motor assembly 335 at the variable speed according to the surrounding temperature. The inverter 355 modulates the frequency applied to the motor assembly 335 from the electric source by the control signal generated from the control section 345.

Accordingly, the control section 345 rotates the motor assembly 335 at the variable speed according to the outdoor temperature or the evaporator 310 surface detected by the first and second temperature sensors 315 and 325.

When the electric power is applied to the air-conditioning system 300, the control section 345 sends the control signal to the inverter 355, and the inverter 355 applies the modulated frequency to the motor assembly 335. And, the control section 345 receives the outdoor temperature detected from the first temperature sensor 315 and determines whether or not the outdoor temperature is 20 degrees.

When the outdoor temperature detected from the first temperature sensor 315 is over 20 degrees, the control section 345 determines whether or not the outdoor temperature is between 20–40 degrees.

When the outdoor temperature is between 20–40 degrees, since the cooling load of the air-conditioning system 300 is normal load state, the control section 345 sends the signal to the inverter 355 for rotating the motor assembly 335 at the normal speed. Accordingly, the air blown from the blower 330 (FIG. 3) cools the surface of the evaporator 310 so that the internal pressure of the condenser 310 is maintained at predetermined pressure by the cooling of the evaporator 310. The predetermined pressure is applied to the evaporator 320, and the internal pressure of the evaporator 320 is also maintained at the predetermined pressure so that the surface temperature of the evaporator 320 is maintained over 0 degrees, thereby preventing the evaporator of the air-conditioning system from freezing.

When the outdoor temperature is over 20–40 degrees, since the cooling load of the air-conditioning system 300 is in an overload state, the output of the compressor 305 is increased, and the refrigerant supplied from the compressor 305 to the condenser 310 is in the high temperature and pressure state. Accordingly, since the internal pressure of the condenser 310 should be maintained at the predetermined pressure, the control section 345 rotates the motor assembly 335 at the high speed. The control section 345 sends the control signal to the inverter 355 for rotating the motor assembly 335 at the high speed. The inverter 355 applies the frequency of the 120 Hz to the motor assembly 335 for rotating the motor assembly at the high speed. Accordingly, the condenser 310 is cooled at the predetermined temperature, and the high temperature and pressure refrigerant passing the internal portion of the condenser 310 are maintained at the predetermined pressure. The refrigerant is circulated to the evaporator 320, and the internal pressure of the evaporator 320 is maintained at the predetermined pressure. Consequently, the surface temperature of the evaporator 320 is maintained at over 0 degrees, thereby preventing the evaporator of the air-conditioning system from freezing.

When the outdoor temperature is below 20 degrees, the control section 345 determines whether or not the outdoor temperature is between 15–20 degrees.

When the outdoor temperature is between 15–20 degrees, the air-conditioning system is in a low load state relative to the normal state. Accordingly, the output of the compressor 305 is lowered relative to the over load state, and the refrigerant supplied from the compressor 305 to the condenser 310 is in the low temperature state relative to the overload state. Accordingly, the control section 345 sends the control signal to the inverter 355 for rotating the motor assembly at the middle speed. The inverter 355 applies the frequency of 40–50 Hz to the motor assembly 335 for rotating the motor assembly 335 at the middle speed. The control section 345 rotates the motor assembly 335 at the middle speed so that the refrigerant passing through the internal portion of the condenser 310 is maintained at the predetermined pressure. The refrigerant is circulated to the evaporator 320, and the internal pressure of the evaporator 320 is maintained at the predetermined pressure so that the surface temperature of the evaporator 320 is maintained over 0 degrees, thereby preventing the evaporator of the air-conditioning system from freezing.

When the outdoor temperature is below 15–20 degrees, the air-conditioning system is in a lower load state than the system if the outdoor temperature was between 15–20. Accordingly, the output of the compressor 305 is lowered relative to the 15–20 degrees case, the refrigerant supplied by the compressor 305 to the condenser 310 is the lower temperature state compared to the lower load state. Accordingly, the control section 345 sends the control signal for rotating the motor assembly at the low speed. The inverter 355 applies the frequency of the 30 Hz to the motor assembly 335 for rotating the motor assembly 335 at the low speed. The control section 345 rotates the motor assembly 335 at the low speed so that the refrigerant passing the internal portion of the condenser 310 is maintained at the predetermined pressure. The refrigerant is circulated to the evaporator 320, and the internal pressure of the evaporator 320 is maintained at the predetermined pressure so that the surface temperature of the evaporator 320 is maintained over 0 degrees, thereby preventing the evaporator of the air-conditioning system from freezing.

On the other hand, the control section 345 receives the surface temperature of the condenser by the second temperature sensor 325 for varying the R.P.M. of the motor assembly 335. The condenser 310 display a maximum efficiency at 50 degrees.

While the air blown from the blower 330 makes continuous contact with the surface of the condenser 310, the surface temperature of the condenser 310 rises or falls.

Therefore, the control section 345 should maintain the surface temperature of the condenser 310 at 50 degrees. Accordingly, the control section 345 determines whether or not the surface temperature of the condenser 310 is 50 degrees. When the surface temperature of the condenser 310 rises above the 50 degrees, the control section 345 rotates the motor assembly 330 at the normal speed so that the surface temperature of the condenser 310 is maintained a 50 degrees. Moreover, when the surface temperature of the condenser 310 is below 50 degrees, the control section 345 rotates the motor assembly 330 at the low speed so that the surface temperature of the condenser 310 is maintained at 50 degrees.

Hereinafter, the method for preventing the evaporator of the air-conditioning system from freezing according to the first embodiment will be explained in more detailed in reference to FIGS. 3 and 5.

FIG. 3 is the plan view showing the structure of the evaporator according to the present invention, and FIG. 5 is the flow chart showing the method for preventing the evaporator of the air-conditioning system from freezing.

The method for preventing an evaporator of an air conditioner from freezing, the method comprising the steps of:

(1) detecting an outdoor temperature by a first temperature sensor while driving a motor assembly at a normal speed;

(2) determining whether or not the outdoor temperature is 20° C.;

(3) determining whether or not the outdoor temperature is in a first temperature range if the outdoor temperature detected in step (2) is higher than 20° C.;

(4) determining whether or not the outdoor temperature is in a second temperature range if the outdoor temperature detected in step (2) is lower than 20° C.;

(5) varying an R.P.M. of the motor assembly based on the outdoor temperature detected in steps (3) and (4);

(6) detecting a surface temperature of a condenser and determining whether or not the surface temperature of the condenser is in a third temperature range;

(7) repeating steps (1) through (6) if the surface temperature of the condenser is higher than the third temperature range; and (8) rotating the motor assembly at a low speed if the surface temperature of the condenser is lower than the third temperature range.

The normal speed means an R.P.M. of the motor assembly when the frequency of the electric power is 60 Hz, and the middle speed means an R.P.M. of the motor assembly when the frequency of the electric power is 40–50 Hz, the low speed means an R.P.M. of the motor assembly when the frequency of the electric power is 30 Hz, and the high speed means an R.P.M. of the motor assembly when the frequency of the electric power is 120 Hz.

In step (1) S510, when the electric power is applied to the air-conditioning system 300, the control section 345 sends the signal to the inverter 355 for rotating the motor assembly 335. The inverter 355 modulates the frequency to the normal frequency of the 60 Hz and applies the 60 Hz to the motor assembly 335 so as to rotate the motor assembly 335 at the normal speed. Moreover, the control section 345 receives the outdoor temperature detected by the first temperature sensor.

In step (2) S520, the control section 345 receives the first signal detected by the second temperature sensor 315, and the control section 345 determines whether or not the outdoor temperature is 20 degrees.

In step (3) S530, when the outdoor temperature is between 20–40 degrees, since the cooling load is in a normal load state, the control section 345 sends the signal to the inverter 355 for rotating the motor assembly 335 at the normal speed. The inverter 355 modulates the frequency to the normal frequency of 60 Hz by the signal generated from the control section 345 and applies the 60 Hz to the motor assembly 335 so as to rotate the motor assembly 335 at the normal speed. Accordingly, the air blown from the blower 330 cools the surface of the evaporator in the predetermined temperature, and the internal pressure of the condenser 310 is maintained over the predetermined pressure by the cooling of the condenser 310. The predetermined pressure is applied to the evaporator 320, and the internal pressure of the evaporator 320 is maintained over the predetermined pressure so that the surface temperature of the evaporator rises over 0 degrees, thereby preventing the evaporator of the air-conditioning system from freezing.

In step (4) S540, when the outdoor temperature is below 20 degrees, the control section 345 determines whether or not the outdoor temperature is between 15–20 degrees.

In step (5) S550, when the outdoor temperature is over 20–40 degrees, since the cooling load of the air-conditioning system 300 is in an overload state, the output of the compressor 305 is increased, and the refrigerant supplied from the compressor 305 to the condenser 310 is in a high temperature and pressure state. Accordingly, since the internal pressure of the condenser 310 should be maintained at the predetermined pressure, the control section 345 rotates the motor assembly 335 at the high speed by cooling the condenser 310 by the predetermined pressure. The control section 345 sends the control signal to the inverter 355 for rotating the motor assembly 335 at the high speed. The inverter 355 applies the frequency of 120 Hz to the motor assembly 335 for rotating the motor assembly at the high speed. Accordingly, the condenser 310 is cooled by the predetermined temperature, the high temperature and pressure refrigerant passing the internal portion of the condenser 310 is maintained at the predetermined pressure. The refrigerant is circulated to the evaporator 320, and the internal pressure of the evaporator 320 is maintained at the predetermined pressure. Consequently the surface temperature of the evaporator 320 is maintained at over 0 degrees, thereby preventing the evaporator of the air-conditioning system from freezing.

When the outdoor temperature is in between 15–20 degrees, the air-conditioning system is in the low load state. Accordingly, the output of the compressor 305 is low relative to the overload state, the refrigerant supplied from the compressor 305 to the condenser 310 is in the low temperature state relative to the overload state. Accordingly, the control section 345 sends the control signal to the inverter 355 for rotating the motor assembly at the middle speed. The inverter 355 applies the frequency of 40–50 Hz to the motor assembly 335 for rotating the motor assembly 335 at the middle speed. The control section 345 rotates the motor assembly 335 at the middle speed so that the refrigerant passing through the internal portion of the condenser 310 is maintained at the predetermined pressure. The refrigerant is circulated to the evaporator 320, and the internal pressure of the evaporator 320 is maintained at the predetermined pressure so that the surface temperature of the evaporator 320 is maintained over 0 degrees, thereby preventing the evaporator of the air-conditioning system from freezing.

When the outdoor temperature is below 15–20 degrees, the air-conditioning system is in a lower load state than when the outdoor temperature is between 15–20 degrees. Accordingly, the output of the compressor 305 is low relative to the low load state, and the refrigerant supplied from the compressor 305 to the condenser 310 is in the low temperature state compared to the low load state. Accordingly, the control section 345 sends the control signal for rotating the motor assembly at the low speed. The inverter 355 applies the frequency of the 30 Hz to the motor assembly 335 for rotating the motor assembly 335 at the low speed. The control section 345 rotates the motor assembly 335 at the low speed so that the refrigerant passing the internal portion of the condenser 310 is maintained at the predetermined pressure. The refrigerant is circulated to the evaporator 320, and the internal pressure of the evaporator 320 is maintained at the predetermined pressure so that the surface temperature of the evaporator 320 is maintained over 0 degrees, thereby preventing the evaporator of the air-conditioning system from freezing.

In the step (6) S560, the second temperature sensor 325 detects the surface temperature of the condenser 310 for sending the second signal to the control section 345. The control section 345 receives the second signal, and determines whether or not the surface temperature of the condenser is 50 degrees.

In step (7) S570, when the surface temperature of the condenser 310 is over 50 degrees, the control section 345 returns to the first step S510. That is, the control section 345 sends the signal to the inverter 355 for rotating the motor assembly 335 at the normal speed. The inverter 355 modulates the frequency of the 60 Hz, and rotates the motor assembly 335 at the normal speed. Accordingly, the surface temperature is maintained at 50 degrees.

In step (8) S580, when the surface temperature of the condenser is below 50 degrees, the control section 345 sends the signal to the inverter 355 for rotating the motor assembly 335 at the low speed. The inverter 355 modulates the frequency into the 30 Hz for applying the 30 Hz to the motor assembly 335 for rotating the motor assembly 335 at the low speed.

Figure 6:
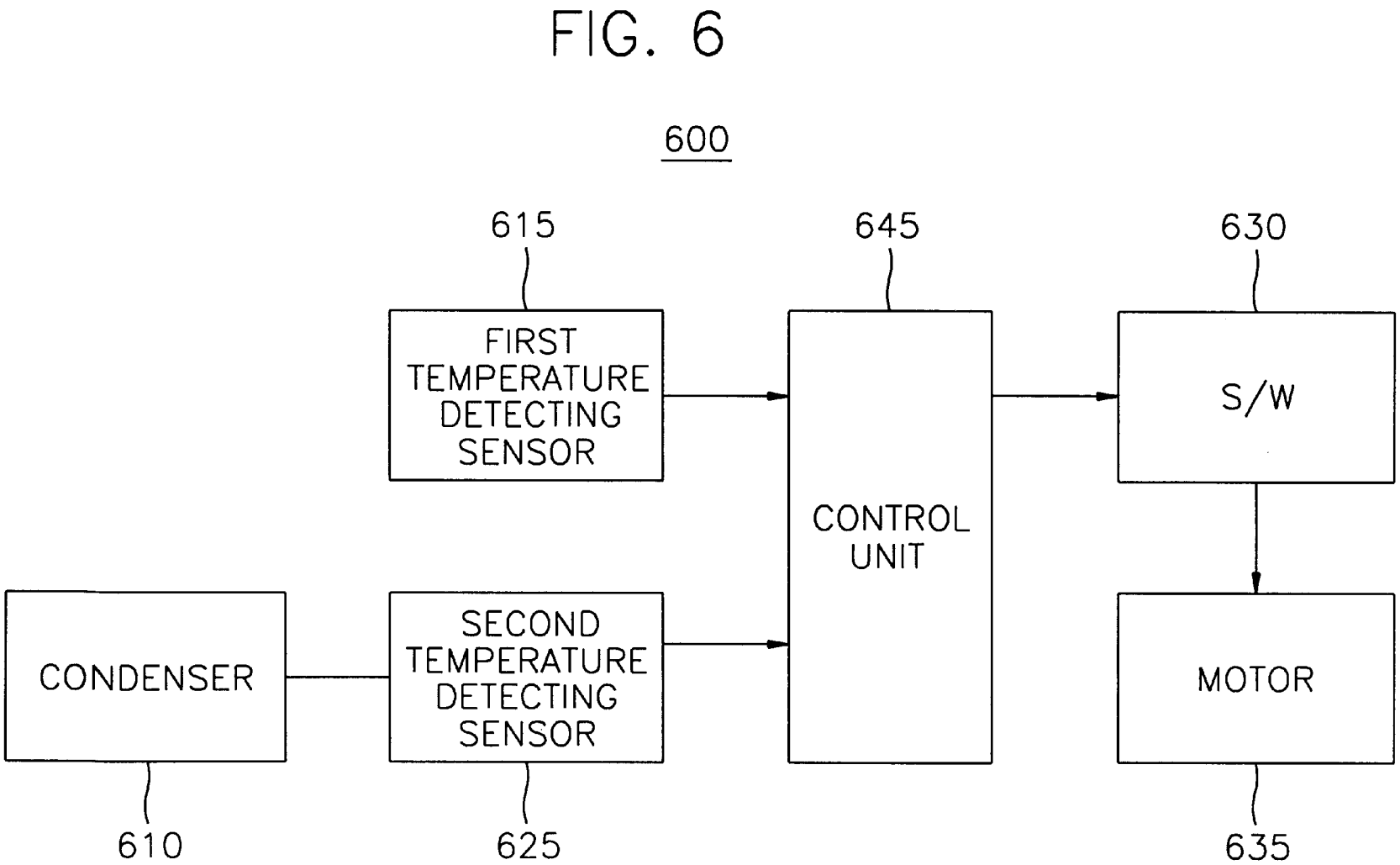
FIG. 6 is a block diagram showing a second embodiment of a freeze-preventing apparatus of the air-conditioning system according to the present invention.

Hereinafter, the apparatus and method for preventing the evaporator from freezing according to the second embodiment will be explained in more detail in reference to FIGS. 6 and 7.

As illustrated, the control section 645 is connected to the first temperature sensor 615 which detects the outdoor temperature for generating the first signal and the second temperature sensor 625 which detects the surface temperature of the condenser 610 for generating the second signal. The control section 645 receives the first and second signals received from the first and second temperature sensors 615 and 625, and the control section 645 sends the control signal to the switch 630 for rotating the motor assembly 635 at the variable speed according to the surrounding temperature. The switch 630 applies the electric power to the motor assembly 635 by the control signal generated from the control section 645.

As mentioned above, the control section 645 receives the outdoor temperature or the evaporator 610 surface from the first and second temperature sensors 615 and 625 so as to control the R.P.M. of the motor assembly 635.

When the electric power is applied to the air-conditioning system 600, the control an section 645 rotates the motor assembly 635, and detects the outdoor temperature through the first temperature sensor 615. The control section 645 determines whether or not the outdoor temperature is 20 degrees.

When the outdoor temperature is over 20 degrees, the control section 645 sends the signal to the switch 630 for applying the electric power to the motor assembly 635 so that the motor assembly rotates.

When the outdoor temperature is below 20 degrees, the control section 645 sends the signal to the switch 630 for stopping the rotation of the motor assembly 635, and detects the surface temperature of the condenser 610. And, when the surface temperature of the condenser 610 is over 50 degrees, the control section 645 stops the rotation of the motor assembly 635. And, when the surface temperature of the condenser 610 is below 50 degrees, the control section 645 rotates the motor assembly 635.

Figure 7:
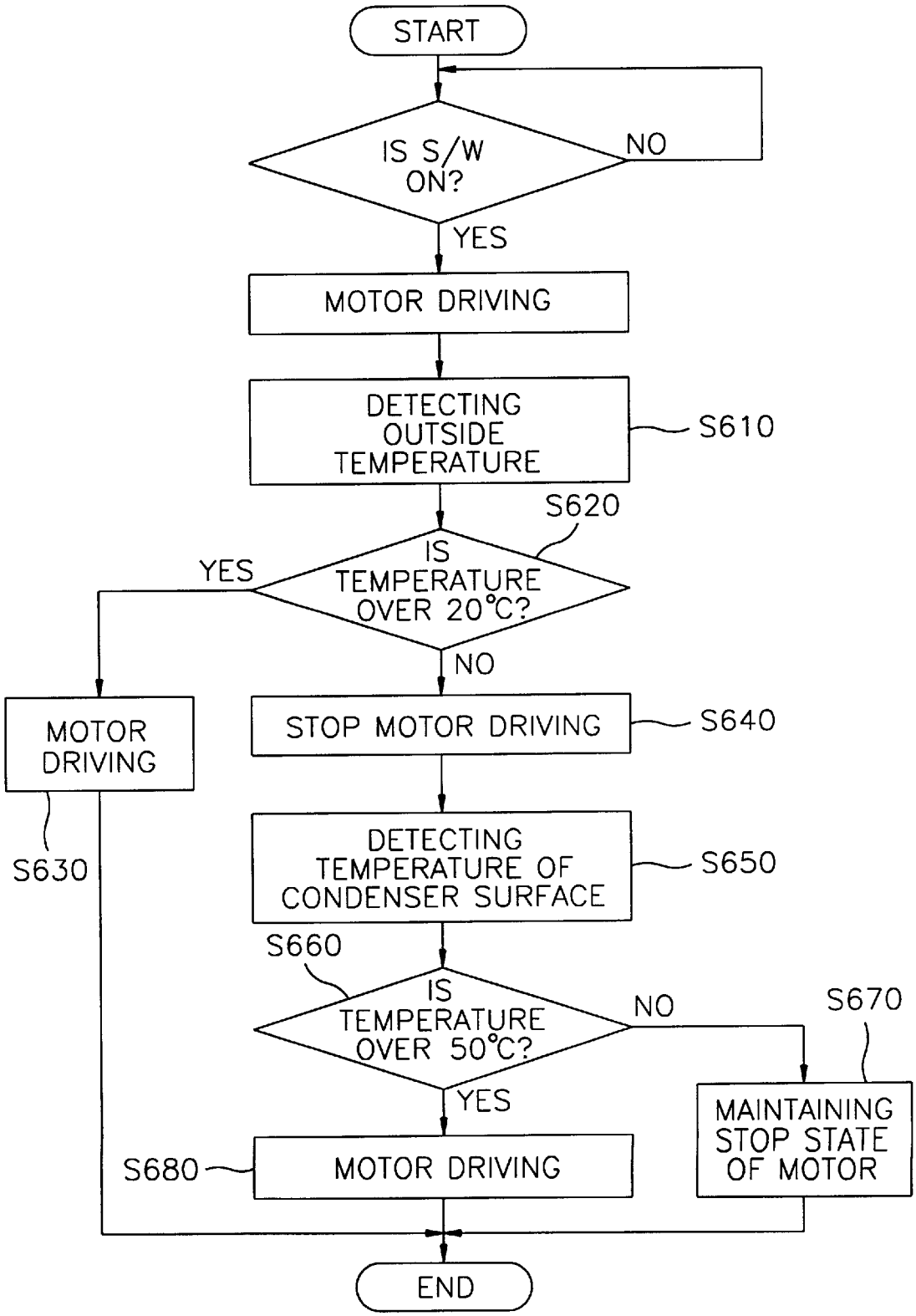
FIG. 7 is a flow chart showing the second embodiment of the freeze-preventing apparatus of the air-conditioning system according to the present invention.

FIG. 7 is a flow chart showing the method for preventing the evaporator of the air-conditioning system from freezing according to the second embodiments of the present invention.

The method for preventing the evaporator of the air-conditioning system from freezing comprises the steps of (1) detecting an outdoor temperature by a first temperature sensor while driving a motor assembly, (2) determining whether or not the outdoor temperature is a first predetermined temperature, (3) rotating the motor assembly at a normal speed if the outdoor temperature detected in step (2) is higher than the first predetermined temperature, (4) stopping an operation of the motor assembly if the outdoor temperature detected in step (2) is lower than the first predetermined temperature, (5) detecting a surface temperature of a condenser, (6) determining whether or not the surface temperature of the condenser is a second predetermined temperature, (7) rotating the motor assembly at the normal speed if the surface temperature of the condenser detected in step (6) is higher than the second predetermined temperature, and (8) maintaining the motor assembly at a stop state if the surface temperature of the condenser detected in step (6) is lower than the second predetermined temperature.

In step (1) S510, when the electric power is applied to the apparatus for preventing the evaporator of the air conditioning from freezing, the control section 645 sends the signal to the switch 630 for rotating the motor assembly 635. The switch 630 rotates the motor assembly 635 by the signal generated from the control section 645. Moreover, the control section 645 receives the outdoor temperature through the first temperature sensor 615.

In step (2) S520, the control section 645 receives the first signal generated from the first temperature sensor 615, and determines whether or not the outdoor temperature is 20 degrees.

In step (3) S530, when the outdoor temperature is over 20 degrees, the control section 645 sends the signal to the switch 630 for applying the electronic power to the motor assembly 635, thereby rotating the motor assembly 635. Accordingly, the air blown from the blower cools the condenser surface, and the internal pressure of the condenser 610 is maintained by the predetermined pressure by the cooling. The predetermined pressure is applied to the evaporator 620, and the internal pressure of the evaporator 620 is maintained by the predetermined pressure so that the surface temperature of the evaporator rises over 0 degrees, thereby preventing the evaporator of the air-conditioning system from freezing.

In step (4) S540, when the outdoor temperature is below 20 degrees, the control section 645 sends the signal to the switch 630 for intercepting the electric power applied to the motor assembly 635. Accordingly, the motor assembly 635 is stopped by the signal.

In step (5) S550, the control section receives the surface temperature of the condenser detected by the second temperature sensor 625. In step (6) S560, the control section determines whether or not the surface temperature of the condenser is 50 degrees.

In step (7) S570, when the surface temperature of the condenser 610 is over 50 degrees, the control section 645 sends the control signal to the switch 630, and the switch 630 applies the electric power to the motor assembly 635. The motor assembly 635 rotates by the control signal so that the surface temperature of the condenser 610 is maintained by the 50 degrees.

In step (8) S580, when the outdoor temperature is below 50 degrees, the control section 645 sends the control signal to the switch 630 for continuously intercepting the electric power applied to the motor assembly 635. Since the motor assembly 635 is maintained at the stop state by the control signal, the surface temperature of the condenser 610 is maintained at the 50 degrees.

As described through the above embodiments, when the surface temperature of the evaporator is below 0 degrees, the surface of the evaporator freezes. When the surface of the evaporator is freezes, the cooling efficiency is decreased. Accordingly, it is required to maintain the surface temperature of the evaporator over 0 degrees for preventing the freezing of the surface thereof.

The apparatus for preventing an evaporator of an air conditioner from freezing is the advantageous in that the apparatus constantly maintains the internal pressure of the evaporator by varing the R.P.M. of the motor assembly according to the outdoor temperature and surface temperature of the condenser so that the internal pressure of the evaporator is constantly maintained, thereby preventing the evaporator of the air-conditioning system from freezing.

While the present invention has been particularly shown and described with reference to preferred embodiments thereof, it will be understood by those skilled in the art that various changes in form and detail may be effected therein without departing from the spirit and scope of the invention as defined by the appended claims.

What is claimed is:

1. An apparatus for preventing an evaporator of an air conditioner from freezing, the apparatus comprising:

a fan disposed at a front of a condenser for blowing an air toward the condenser;

a first temperature sensor which detects an outdoor temperature and generates a first signal;

a second temperature sensor which detects a surface temperature of the condenser and generates a second signal;

a control section which receives the first and second signals from the first and second temperature sensors and generates a control signal based on the first and second signals for varying an R.P.M. of a motor assembly, the motor assembly connected to the fan for rotating the fan; and an inverter which receives the control signal from the control section and modulates a frequency supplied thereto from a power source based on the control signal, thereby applying a modulated frequency to the motor assembly, wherein the control section generates a first control signal for rotating the fan at a high speed when the outdoor temperature is higher than a first predetermined temperature, a second control signal for rotating the fan at a middle speed when the outdoor temperature is lower than or equal to the first predetermined temperature, and a third control signal for rotating the fan at a low speed when the surface temperature of the condenser is lower than a second predetermined temperature, thereby constantly maintaining an internal pressure of the condenser.

2. The apparatus as claimed in claim 1, wherein when the outdoor temperature is higher than the first predetermined temperature, the control section determines whether or not the outdoor temperature is in a predetermined temperature range, the control section rotating the fan at a normal speed when the outdoor temperature is in the predetermined temperature range and the control section rotating the fan at the high speed when the outdoor temperature is higher than the predetermined temperature range.

3. The apparatus as claimed in claim 2, wherein the predetermined temperature range is higher than 20° C. and lower than or equal to 40° C.

4. The apparatus as claimed in claim 1, wherein the first predetermined temperature is 20° C. and the second predetermined temperature is 50° C.

5. The apparatus as claimed in claim 1, wherein when the outdoor temperature is lower than the first predetermined temperature, the control section determines whether or not the outdoor temperature is in a predetermined temperature range, the control section rotating the fan at the middle speed when the outdoor temperature is in the predetermined temperature range and the control section rotating the fan at the low speed when the outdoor temperature is lower than the predetermined temperature range.

6. The apparatus as claimed in claim 5, wherein the predetermined temperature range is 15–20° C.

7. The apparatus as claimed in claim 1, wherein the control section generates the third control signal when the surface temperature of the condenser is lower than 50° C. and generates a fourth signal for rotating the fan at a normal speed when the surface temperature of the condenser is 50° C. or higher than 50° C.

8. A method for preventing an evaporator of an air conditioner from freezing, the method comprising the steps of:

(1) detecting an outdoor temperature by a first temperature sensor while driving a motor assembly at a normal speed;

(2) determining whether or not the outdoor temperature is a first predetermined temperature;

(3) determining whether or not the outdoor temperature is in a first temperature range if the outdoor temperature detected in step (2) is higher than the first predetermined temperature;

(4) determining whether or not the outdoor temperature is in a second temperature range if the outdoor temperature detected in step (2) is the first predetermined temperature or lower than the first predetermined temperature;

(5) varying in R.P.M. of the motor assembly based on the outdoor temperature detected in steps (3) and (4);

(6) detecting a surface temperature of a condenser and comparing it with a second predetermined temperature;

(7) repeating steps (1) through (6) if the surface temperature of the condenser is higher than or equal to the second predetermined temperature; and (8) rotating the motor assembly at a low speed if the surface temperature of the condenser is lower than the second predetermined temperature.

9. The method as claimed in claim 8, wherein step (3) comprises the substeps of rotating the motor assembly at a high speed if the outdoor temperature is higher than the first temperature range, and returning to step (1) if the outdoor temperature is within the first temperature range.

10. The method as claimed in claim 8, wherein, in step (4), the motor assembly is rotated at a middle speed if the outdoor temperature is within the second temperature range.

11. The method as claimed in claim 8, wherein, in step (4), the motor assembly is rotated at the low speed if the outdoor temperature is lower than the second temperature range.

12. The method as claimed in claim 8, wherein the first temperature range is higher than 20° C. and lower than or equal to 40° C., the second temperature range is 15–20° C.

13. The method as claimed in claim 8, wherein the first predetermined temperature is 20° C. and the second predetermined temperature is 50° C.

* * * * *